United States Patent [19]

Gülicher

[11] 4,182,018

[45] Jan. 8, 1980

[54] METHOD OF AND APPARATUS FOR THE STRESSING OF PRESSURE VESSELS

[75] Inventor: Lothar Gulicher, Mönchen-Gladbach, Fed. Rep. of Germany

[73] Assignee: Siempelkamp Giesserei GmbH & Co., Krefeld, Fed. Rep. of Germany

[21] Appl. No.: 894,374

[22] Filed: Apr. 7, 1978

[30] Foreign Application Priority Data

Apr. 9, 1977 [DE] Fed. Rep. of Germany ..... 2716020

[51] Int. Cl.[2] ..... B23P 11/02; B23P 19/04; B66F 3/24

[52] U.S. Cl. ..... 29/446; 29/229; 29/235; 29/252; 254/93 R

[58] Field of Search ..... 29/446, 452, 235, 229, 29/224, 252, 765; 52/224; 254/93 R, DIG. 10

[56] References Cited

U.S. PATENT DOCUMENTS

| | | | |
|---|---|---|---|
| 1,057,159 | 3/1913 | Madsen | 29/446 |
| 1,306,997 | 6/1919 | Bullivant | 254/DIG. 10 UX |
| 2,597,084 | 5/1952 | Huddleston | 52/224 X |
| 3,073,573 | 1/1963 | Haskins | 254/93 R X |
| 3,169,376 | 2/1965 | Cunningham | 254/93 R X |
| 3,210,837 | 10/1965 | Hassellof | 29/446 X |
| 3,500,529 | 3/1970 | Kohout | 29/229 |
| 3,518,748 | 7/1970 | Howlett | 52/224 X |
| 4,124,928 | 11/1978 | Stark | 29/252 X |

FOREIGN PATENT DOCUMENTS

| | | | |
|---|---|---|---|
| 764587 | 8/1967 | Canada | 52/224 |

*Primary Examiner*—Charlie T. Moon
*Attorney, Agent, or Firm*—Karl F. Ross

[57] ABSTRACT

A cylindrical pressure vessel is placed under an inward prestress to resist outward forces by the application of outwardly spread annular stressing means which are then permitted to bear inwardly upon the vessel. The device includes fluid-pressure means for relieving the inward force during the application of the annular means so that at least one ring of the latter can expand outwardly and then contracted on the periphery of the vessel.

10 Claims, 10 Drawing Figures

METHOD OF AND APPARATUS FOR THE STRESSING OF PRESSURE VESSELS

FIELD OF THE INVENTION

The present invention relates to a method of and an apparatus for the stressing of a pressure vessel and, more particularly, to the application of an annular element or ring under an inward stress to the outer periphery of a cylindrical pressure vessel, preferably a nuclear reactor vessel.

BACKGROUND OF THE INVENTION

In nuclear reactor technology, it is customary to enclose the reactor core in a pressure vessel or containment which can be of cylindrical configuration and can be composed of concrete or, more advantageously, can be assembled from a multiplicity of annular elements of cast iron or the like.

Cast iron rings, for example, may be stacked to form the pressure vessel for enclosure and, instead of rings, cast iron segments can be assembled for this purpose.

In either case, the elements are placed under axial prestress by tension elements running through the walls of the vessel in the vertical direction and appropriate covers, bottoms and linings may be applied as required.

To strengthen the pressure vessel against outward forces, it is not uncommon to provide the cylindrical wall of the vessel with inwardly acting prestressing means which can be, for example, cables extending around the circumference of the vessel and tensioned to apply the desired degree of inward prestress. It is also known to apply rings to the periphery of the vessel and to stress the rings inwardly against the vessel wall with one or more turns of highly tensioned cables.

It is known to apply inward-stressing rings of the aforedescribed type with the aid of a fluid-pressure piston/cylinder arrangement which is capable of spreading the ring and enabling the same to be slipped over the vessel. Earlier systems of this type tend to deform the ring into a polygonal configuration which remains when the ring is applied to the vessel. Because of the different frictional characteristics of the various parts of the ring in contact with the vessel, it cannot be assured that a uniform inward prestress will be applied over the entire periphery of the latter. Naturally, prestressing of the vessel in this fashion is unreliable and may pose a safety problem in operation of the reactor or vessel.

OBJECTS OF THE INVENTION

It is the principal object of the present invention to provide an improved apparatus for the prestressing of a pressure vessel in the manner described whereby the disadvantages of the earlier systems will be obviated.

Another object of this invention is to provide an improved apparatus for applying a prestressing ring to a pressure vessel which will eliminate or reduce the polygon-distortion effect hitherto encountered in the spreading of a ring for application to the pressure vessel.

Still another object of the invention is to provide an improved method of prestressing a pressure vessel and especially a cylindrical pressure vessel for a nuclear reactor.

SUMMARY OF THE INVENTION

These objects and others which will become apparent hereinafter are attained, in accordance with the present invention, in a system for inwardly prestressing a pressure vessel, especially the pressure vessel of a nuclear reactor, which comprises a ring (bearing ring) adapted to be pressed against the outer wall of this vessel and to hug the latter under inward prestress, means including at least one tensionable elongated element extending around this ring for exerting an inward prestressing force thereon, and an apparatus for spreading this ring, the apparatus comprising force-transmitting shoes with respective claws or fingers operatively engageable from above and below with the last-mentioned element, a yoke connecting the claws or shoes of each engaging device together, a spreading ring lying inwardly of the yokes of the multiplicity of devices angularly equispaced around the bearing ring, and respective fluid-pressure piston/cylinder arrangements for each device between the respective yoke and the spreading ring so that the element can be drawn uniformly outwardly to spread the bearing ring for lowering onto the pressure vessel.

Upon removal of the yokes, following depressurization of the piston/cylinder arrangements, the shoes or claws can be removed leaving the bearing ring and the stressing elements in place.

According to a feature of the invention, the prestressing elements can be cables, wires or circular-section steel rods which can be emplaced in outwardly open channels of the bearing ring or of separate members which, in turn, rest against this ring. The element or elements can be coiled into these channels in one or more turns and can be prestressed to the desired degree.

In accordance with the invention, the bearing ring can be a closed prestressing ring upon which the prestressing elements are coiled although it is also possible to form this prestressing ring as a split ring or to have a plurality of elements bearing directly against the wall of the vessel, these elements constituting ring segments. The preferred mode, however, is a closed ring formed directly (unitarily) with the aforementioned channel.

The coiling of the prestressing element or elements in the channel poses no problem since, until the various devices are applied, the channel remains fully open. Naturally, an additional space can be applied once the bearing ring is in place upon the pressure vessel.

In another embodiment of the invention, I make use of bearing shoes which rest, in turn, upon a bearing ring and which are formed with the outwardly open channel-shaped recess. In either case, the bearing and/or the bearing shoes can be connected, during the mounting process, to the spacing ring by the several devices. For the application of the coiled prestressing elements, the bearing shoes can be held against inward movement by the bearing ring and the latter supported by a mandrel or support ring or, where the elements are applied directly to the bearing ring, the latter may be held against inward movement by the support ring which thus takes up the prestressing force. The devices can be hydraulically actuated to spread the bearing ring and/or the shoes outwardly and enable the stress and assembly to be removed from the support ring. The support ring can thus form part of the coiling and stress-applying system.

The assembly of the present invention has been found to be particularly effective for the application of uniform stressing forces to the pressure vessel and to be free from the tendency to distort the innermost member of the assembly into a polygonal configuration.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
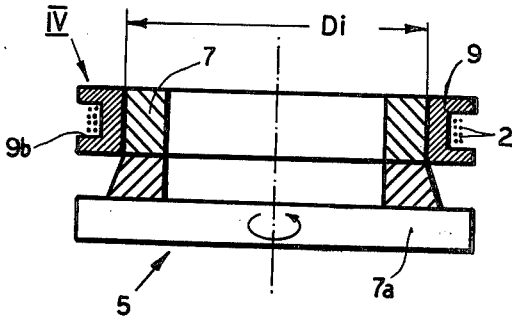
FIG. 1 is an axial cross-sectional view through a stressing assembly adapted to be applied to a pressure vessel in accordance with the present invention.

In FIG. 1 of the drawing I have illustrated the preparation of a stressing assembly for application to a pressure vessel, especially a containment for a core of a nuclear reactor. The assembly comprises a bearing ring 9 whose internal diameter D may be slightly less in a relaxed state than the outer diameter $D_o$ of the vessel to which the ring is to be applied. Alternatively, $D_i$ may be equal to or slightly greater than $D_o$ prior to the application of the stressing elements as will be described in greater detail below.

According to the invention, the ring 9, which is formed with an outwardly open channel **9*b*, is mounted upon a support ring or mandrel 7 which can be formed as part of a turntable 7*a* constituting the rotor of a coiling station generally represented at 5 in which an elongated element, e.g. a stressing cable 2, is wound in a multiplicity of turns in the channel 9*b*. It will be understood that, instead of a cable, a round-section reinforcing rod, a flattened strap or other tensionable member may be used for this purpose and that these elements may be single-turn or multi-turn members respectively. In either case, the elements 2 are tensioned so as to apply a sufficient prestress inwardly so that the diameter $D_i$ of the ring 9 is reduced below the outer diameter $D_o$ of the vessel. This inward prestressing force is taken up by the ring 7. Naturally, using conventional means, the elements 2 can be tensioned further after the assembly 2, 9**, is applied to the pressure vessel, whereupon the inward prestress can be increased.

Figure 2:
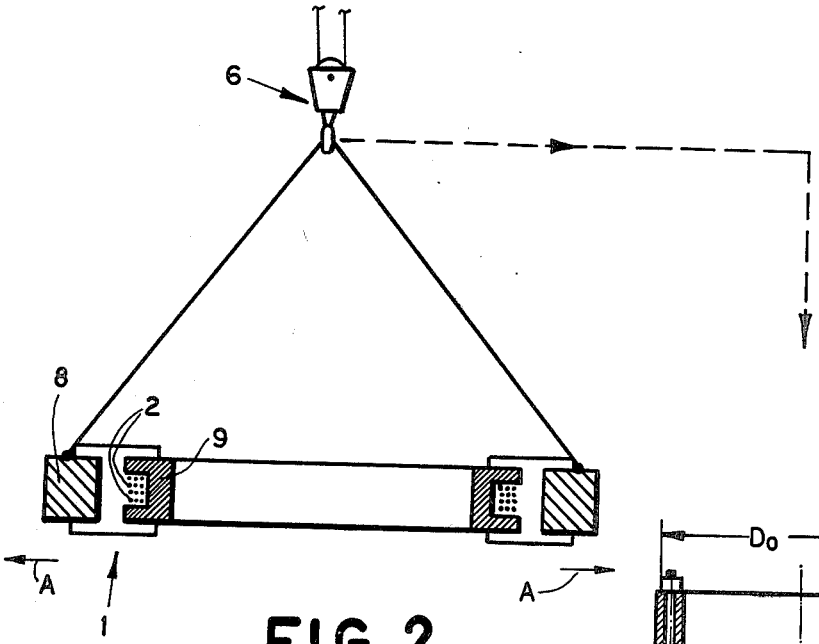
FIG. 2 is an axial cross-sectional view, partly in diagrammatic form, illustrating the shifting of the assembly into alignment with a pressure vessel, the latter being illustrated diagrammatically.
Figure 6:
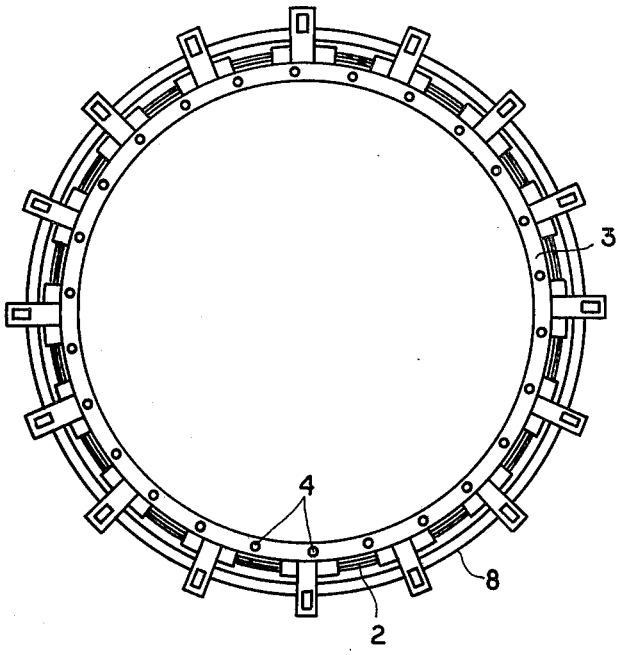
FIG. 6 is a top plan view of an assembly of the type illustrated in FIGS. 4 and 5 in place on the pressure vessel, before removal of the stretching devices.
Figure 7:
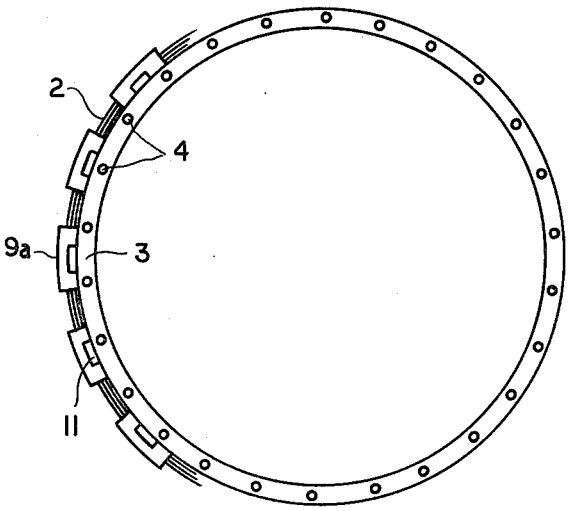
FIG. 7 is a view similar to FIG. 6 after the removal of the stressing devices.

According to the invention, a plurality of stretching devices, generally represented at 1, are angularly equispaced about the bearing ring 9 and engage upon a ring 8 against which the ring 9 is stretched outwardly as represented by the arrows A in FIG. 2, thereby enabling a crane 6 to lift the assembly 2, 9, from the support ring 7 and displace it above the pressure vessel which has generally been represented at 3. The pressure vessel 3, which can be composed of a stack of cast iron rings **3*b* provided with aligned and throughgoing bores 3*a*, is axially and vertically pretensioned by cables or rods 4 angularly equispaced around the wall as can be seen from FIGS. 6–8**.

Figure 3:
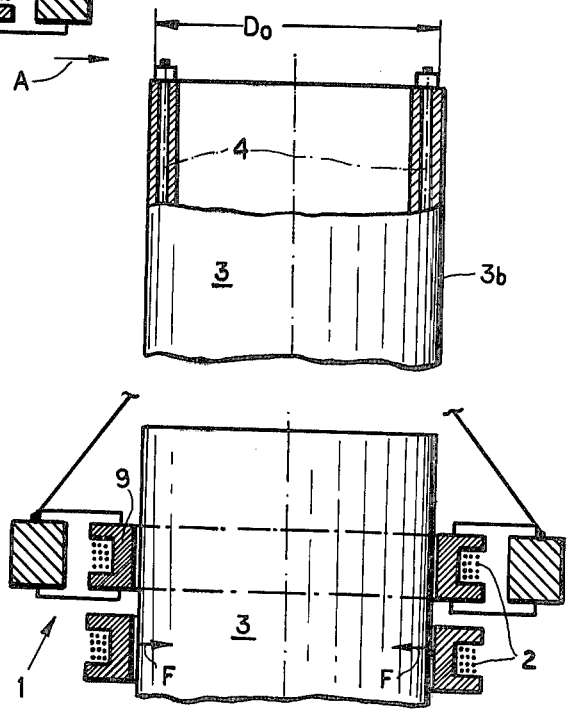
FIG. 3 is a view similar to FIG. 2 but illustrating the emplacement of the stressing assembly on the pressure vessel.

FIG. 3 shows that the assembly 2, 9 can be lowered onto the pressure vessel 3 and the hydraulic force of the devices 1 relaxed to permit the prestressing force to apply the ring 9 to the outer wall of the pressure vessel with inward prestressing forces generally represented by the arrows F.

Figure 8:
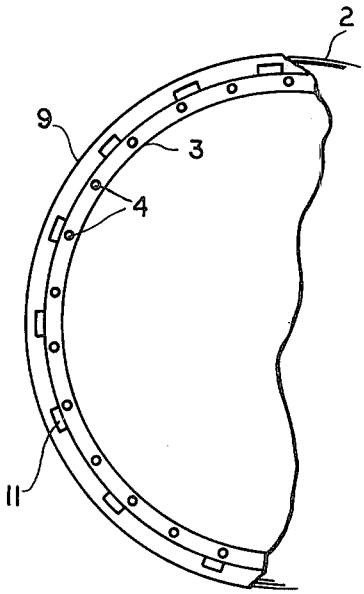
FIG. 8 is a partial plan view illustrating the embodiment of the invention in the state corresponding to FIG. 7 but for the system of FIGS. 1–3.
Figure 9:
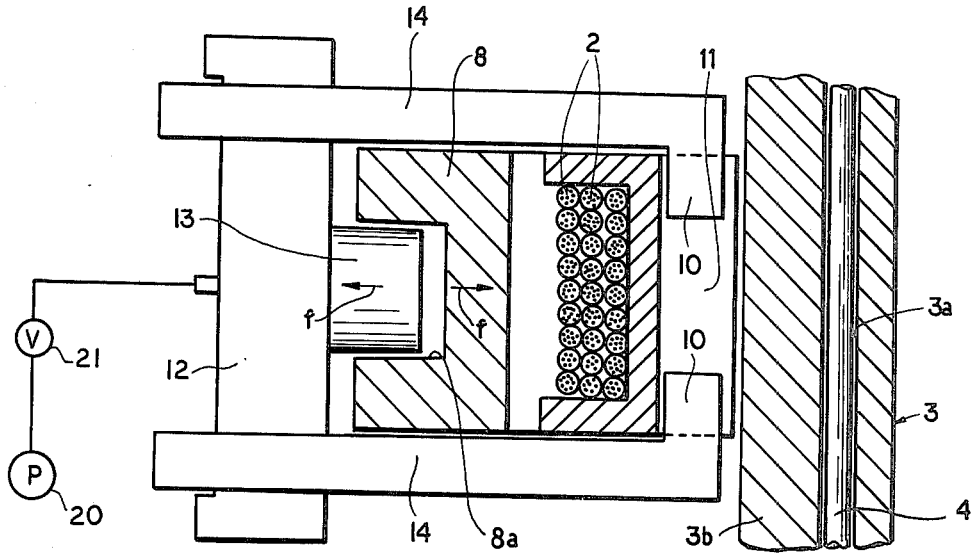
FIGS. 9 and 10 are views similar to FIGS. 4 and 5 but pertaining to the system of FIGS. 1–3.
Figure 10:
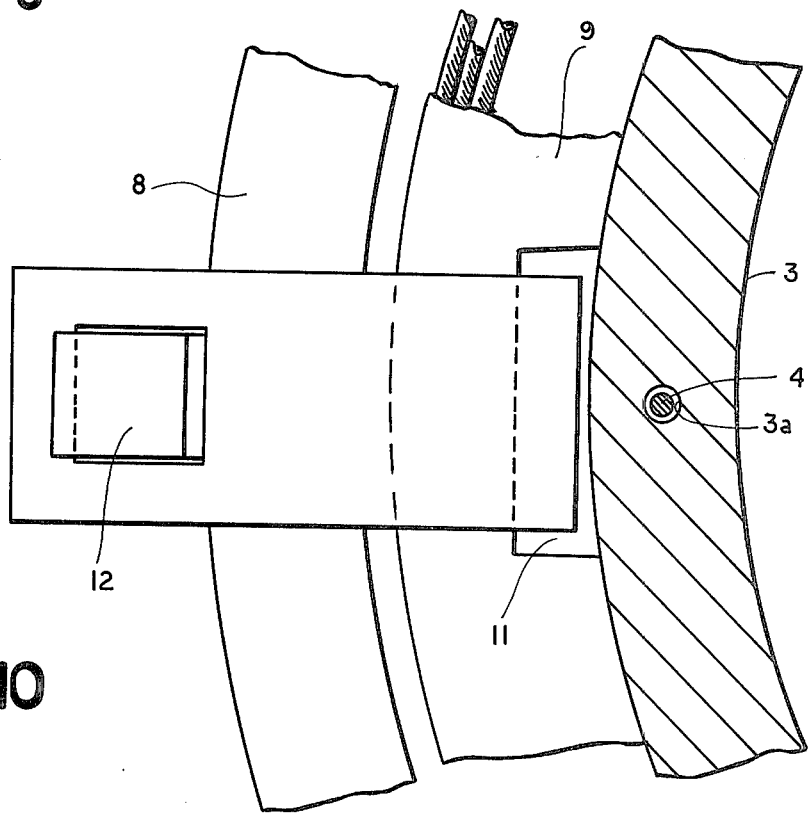

The devices for stretching the assembly, i.e. counteracting the prestressing force for application of the assembly, are of the type illustrated in FIGS. 8, 9 and 10. As can be seen from FIG. 8, the ring 9 is provided with a plurality of axially extending inwardly open recesses 11 which can receive the claws 10 of a pair of shoes 14 of each device. The shoes 14 are formed at their ends remote from the claws 10, which engage the ring 9 from above and below, with windows **14*a* (see FIG. 4) of a width W in excess of the width w of the legs 12*a* and 12*b* of a yoke 12 adapted to span the shoes. Thus the legs 12*a* and 12*b* overhang the shoes 14 and prevent dislocation thereof during the stretching operation. The yoke 12 of each device 1 is formed with a piston 13 receivable in a cylinder bore 8*a* formed in the ring 8. A hydraulic source represented by a pump 20 and a valve 21 is connected to all of the devices in parallel to enable pressurization of the respective cylinders 8*a* so that a force f is exerted as illustrated in FIG. 9 to draw the ring 9 outwardly and thereby apply a similar force to the stressing elements 2 as represented by the arrow f'. When the hydraulic fluid pressure is relieved, the prestressing forces applied to the wall 3*b* of the pressure vessel 3 and the legs 12*a* and 12*b* can be slipped through the slots 14*a* to disassemble the device and permit removal of the shoes 14, the yoke 12 and ultimately the ring 8 from the assembly 2, 9**.

Figure 4:
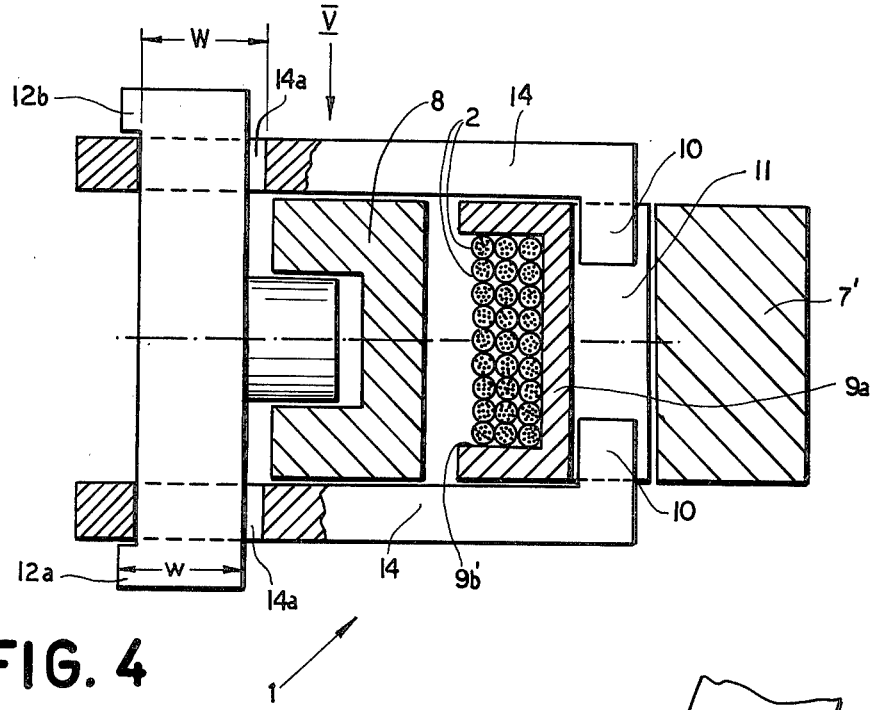
FIG. 4 is an enlarged detail of the portion A of a stressing assembly according to another embodiment of the invention, showing the assembly-spreading device in place.
Figure 5:
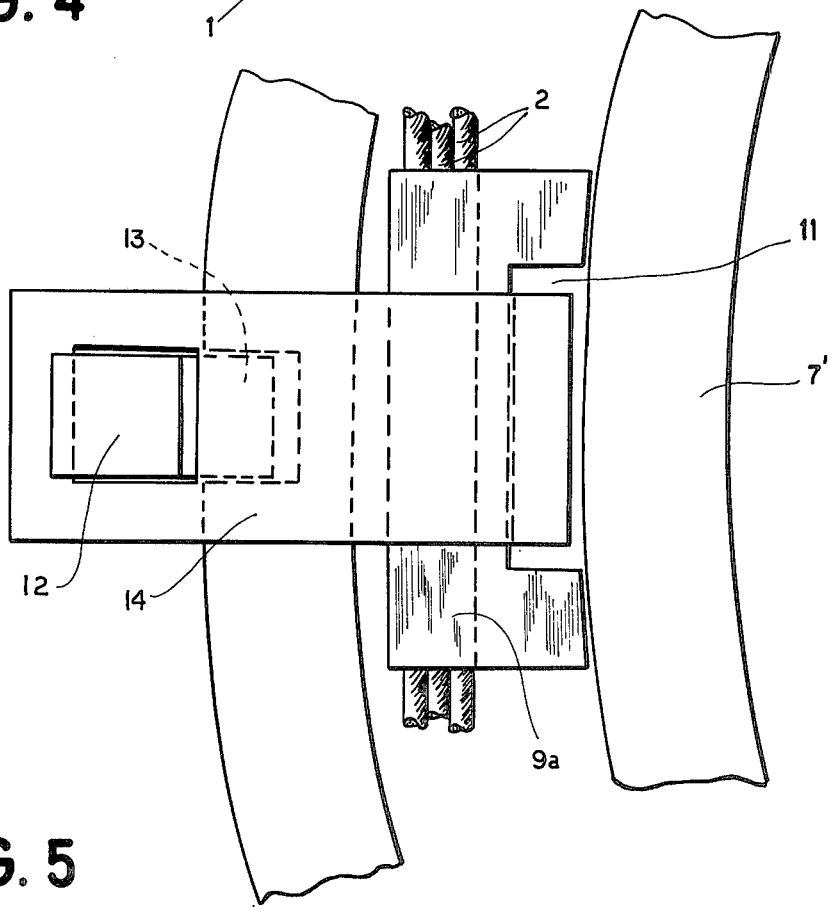
FIG. 5 is a view taken in the direction of the arrow V of FIG. 4.

FIGS. 4 and 5 show that the bearing ring 7' which rests against the wall of the pressure vessel 3 (see FIGS. 6 and 7) can be urged inwardly by a plurality of angularly equispaced pressure shoes **9*a* formed with the outwardly open channels 9*b'* in which the stressing elements 2 are received. In this case, the inward force of the shoes 9*a* can be applied to the vessel 3 through a bearing ring 7' or directly to the wall of the vessel 3 once the shoes are spread away from the support ring 7 (FIG. 1). The system of FIGS. 4 and 5 thus operates similarly to that of FIGS. 9 and 10**.

I claim:

1. A method of inwardly prestressing a pressure vessel comprising the steps of:

disposing at least one annular stressing member on a support ring and coiling at least one tension element around said member to stess the same against said support ring;

drawing said element outwardly at a plurality of spaced locations around said support ring, thereby increasing the diameter of the assembly consisting of said member and said element;

while maintaining the increased diameter of said assembly, slipping same over said pressure vessel; and releasing the outward force on said element, thereby forcing said member against said vessel to apply inward prestress thereto.

2. The method defined in claim 1 wherein at each of a multiplicity of locations around said assembly, said member is gripped from above and below by a pair of claws which are urged outwardly by fluid pressure against a spreading ring surrounding said member to increase the diameter of said assembly.

3. An apparatus for prestressing a cylindrical pressure vessel comprising:

a stressing assembly comprising annular means including at least one member adapted to surround said vessel and bear against a wall thereof, and at least one tensioned element surrounding said annular means for urging same against said wall;

a stretching ring surrounding said annular means and spaced therefrom; and a plurality of devices for increasing the diameter of said assembly to enable same to be slipped over said vessel, each of said devices comprising a pair of elongated shoes formed with claws engaging said annular means from above and below and straddling said ring, a respective yoke interconnecting the shoes of each device, and respective piston/cylinder arrangements between each yoke and said ring for urging the shoes of the respective device outwardly.

4. The apparatus defined in claim 3 wherein said annular means is a bearing ring lying inwardly of said stretching ring and formed with an outwardly open channel receiving said element.

5. The apparatus defined in claim 4 wherein said bearing ring is formed with a plurality of recesses each receiving the claws of a respective device.

6. The apparatus defined in claim 3 wherein said annular means is an array of stressing shoes each associated with a respective one of said devices and formed with an outwardly open channel receiving said element.

7. The apparatus defined in claim 6 wherein each of said bearing shoes is formed with a recess receiving the claws of a respective device.

8. The apparatus defined in claim 3 wherein said element is a multiturn cable wound in an outwardly open channel formed in said member.

9. The apparatus defined in claim 3, further comprising a support ring against which said annular means rests during tensioning of said element.

10. The apparatus defined in claim 9 wherein said support ring constitutes part of a coiling and stressing device for said element.

* * * * *